United States Patent [19]

Dandy, III

[11] Patent Number: 4,759,570

[45] Date of Patent: Jul. 26, 1988

[54] SKI ASSEMBLY

[76] Inventor: Walter Dandy, III, Sow's Ear House, Monkton, Md. 21111

[21] Appl. No.: 17,092

[22] Filed: Feb. 20, 1987

[51] Int. Cl.[4] ..... A63C 9/00

[52] U.S. Cl. ..... 280/812

[58] Field of Search ..... 280/11.36, 809, 812, 280/819, 12 F

[56] References Cited

U.S. PATENT DOCUMENTS

| | | | |
|---|---|---|---|
| 983,721 | 2/1911 | Irish | 280/11.36 |
| 3,928,872 | 12/1975 | Johnson | 2/22 |
| 4,265,462 | 5/1981 | Willi | 280/11.36 |
| 4,408,600 | 10/1983 | Davis | 2/22 X |

FOREIGN PATENT DOCUMENTS

| | | | |
|---|---|---|---|
| 426174 | 10/1924 | Fed. Rep. of Germany | 280/812 |
| 2238038 | 2/1973 | Fed. Rep. of Germany . | |
| 3005190 | 8/1981 | Fed. Rep. of Germany | 280/812 |
| 2539041 | 7/1984 | France | 280/12 F |
| 426891 | 11/1947 | Italy | 280/809 |
| 185703 | 10/1936 | Switzerland | 280/812 |

OTHER PUBLICATIONS

Physics Principles, pp. 116 and 117, Ballard et al, D. Van Nostrand Co., Apr. 1954.

*Primary Examiner*—John J. Love
*Assistant Examiner*—Michael Mar
*Attorney, Agent, or Firm*—Birch, Stewart, Kolasch & Birch

[57] ABSTRACT

A ski assembly and method of use are provided for shifting the upper body weight of a skier from the skier's legs to the skier's skis and ski boots to reduce the strain on the legs of the skier.

19 Claims, 2 Drawing Sheets

SKI ASSEMBLY

FIELD OF INVENTION

This invention relates to a ski assembly. More particularly, the invention relates to a ski pole assembly which enables the shifting of the upper body weight of a skier from the legs of the skier to the skis and ski boots of the skier to lessen strain on the legs of the skier.

BACKGROUND OF THE INVENTION

Skiing has become an extremely popular sport over the years. The sport is enjoyed by virtually all age groups, and the ski season extends for almost the entire year. Due to the popularity of skiing, a major world industry has developed for ski equipment. Over the past few years, ski equipment has advanced significantly to enhance skiing performance and safety. For example, strides have been made in the manufacture of skis, ski boots, braces for the ankles and knees, and ski clothes. Additionally, exercise books and courses have been written and designed specifically for conditioning the skier.

The most important equipment in skiing are the skis and ski boots. Skis and ski boots vary in sizes, styles, and configurations to meet the specific needs of the skier and are constructed to meet the particular demands of the sport. Additionally, ski poles are used by the skier. Ski poles are primarily used (excluding cross country skiing) for getting the skier to and from the ski slope, helping the skier up after a fall, and pushing off when making turns. However, the ski poles are not necessary when skiing down the slope. In fact, in some instances, the use of ski poles has disadvantages. Their use is the source of skiing's most prevalent injury "skier's thumb" injury, i.e. the pushing back of the thumb by the ski pole in a fall.

Skiing generally, and turning techniques particularly, place unusual strain on the skier's legs. Consequent fatigue is painful and decreases skiing time and the enjoyment of the sport. A substantial amount of the strain on the legs is caused by the upper body weight of the skier and the impact of the skis on the ski slope. Convenient exercise do not exist to prepare the skier adequately for the strain on the skier's legs. Because many skiers are this unprepared, resultant fatigue increases injury risk. However, even with proper conditioning, the skier's legs are still subject to a tremendous amount of strain and pressure. The older or less conditioned the skier, the greater the amount of strain on the legs.

While the ski industry has come up with many innovations over the years in ski equipment, the leg strain and resulting fatigue issue has remained unresolved. Until the present invention, there has been no known ski equipment available to the skier for shifting the upper body weight of the skier from the skier's legs to the skis and ski boots so as to lessen the strain on the legs.

PRIMARY OBJECTS AND SUMMARY OF THE INVENTION

The present invention provides a novel and relatively simple ski assembly which may be used with conventional skis, ski boots, and ski poles to reduce strain on the legs of the skier.

Accordingly, it is a primary object of the invention to provide a ski pole assembly which will substantially reduce the strain on the legs of the skier.

It is a further primary object of the invention to provide a ski pole assembly which will shift the upper body weight of the skier from the legs of the skier to the skis and ski boots of the skier to preclude the substantial strain on the skier's legs and the resulting fatigue.

It is another object of the invention to provide a ski pole assembly which will provide a shock absorbing effect to the skier's legs from the impact of the skis on the ski slope and thereby reduce the strain on the legs of the skier.

It is another object of the invention to provide a ski pole assembly which will reduce skier fatigue and provide for safer skiing.

It is a further object of the invention to provide a ski pole assembly which will provide greater enjoyment to the skier by reducing fatigue to the skier.

It is a further object of the invention to provide a ski pole assembly which reduces the conventional use of the ski poles and thereby reduces injury caused by the ski poles such as "skier's thumb".

It is a further object of the invention to provide a ski pole assembly which is relatively simple and inexpensive to manufacture.

The present invention provides a simple and efficient means of shifting the upper body weight of a skier from the legs of the skier to the skis and ski boots of the skier to preclude the substantial strain to the skier's legs. The invention can be used with conventional ski equipment and can be installed by the skier in a matter of minutes. Additionally, the ski pole assembly of this invention can be manufactured as part of the ski equipment.

The ski pole assembly provided by the present invention for shifting the upper body weight of the skier from the skier's legs to the skis and ski boots of the skier comprises the use of a first and second ski pole to which is attached a first spring means including means for connection to the back of a first leg of the skier and a second spring means attached to the second ski pole and including means for connection to the back of a second leg of the skier. Further, a first attachment means is provided for attachment to the back of a first leg of the skier for receiving the first spring means, and a second attachment means is provided for attachment to the back of a second leg of the skier for receiving the second spring means. A first socket means is attached to a first ski boot of the first leg of the skier for receivably holding the tip of the first ski pole, and a second socket means is attached to a second ski boot of the second leg of the skier for receivably holding the tip of the second ski pole. The ski pole assembly is used by attaching the first and second spring means to the first and second attachment means and placing the first and second ski pole tips in the first and second socket means whereby the spring means will stretch in response to the crouching movements of the skier when skiing generating forces in opposition to forces generated by the skier's body weight to shift the skier's upper body weight from the legs of the skier through the spring means and ski poles to the skis and the ski boots of the skier. The shifting of the upper body weight to the skis and ski boots will preclude the substantial strain on the legs of the skier.

BRIEF DESCRIPTION OF THE DRAWING

The aforesaid and other objects, advantages, and novel features of the present invention will become apparent from the following detailed description of the invention when considered in conjunction with the accompanying drawing, in which like reference numerals designate like parts throughout the figures thereof, and wherein.

DETAILED DESCRIPTION OF THE INVENTION

Figure 1:
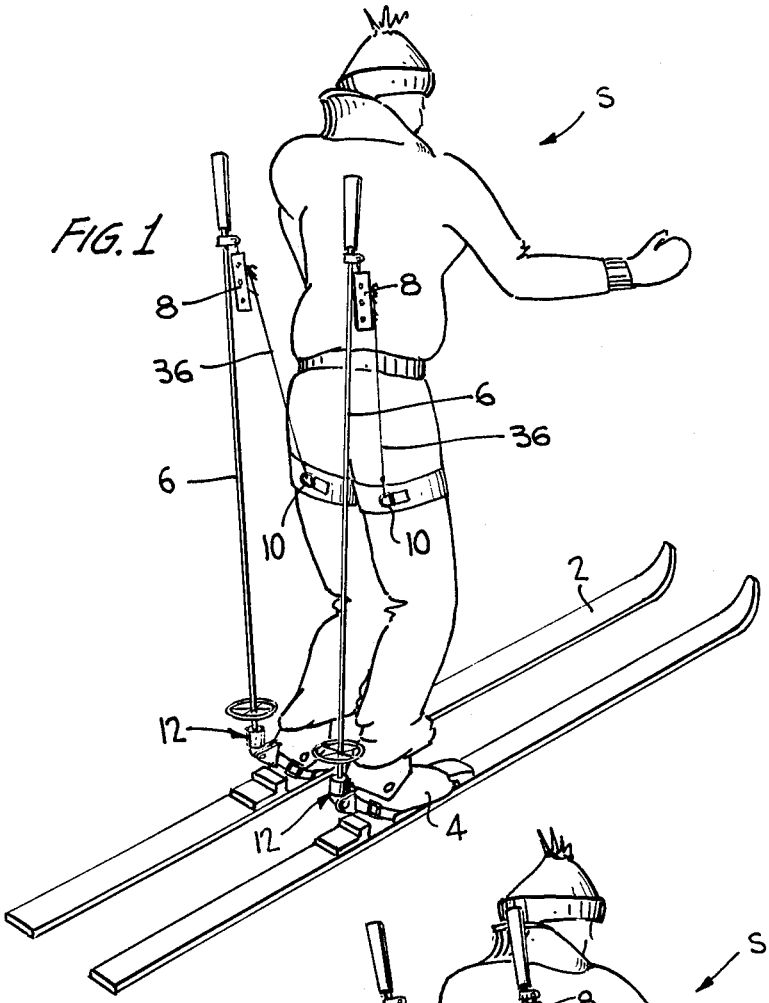
FIG. 1 is a perspective view of a skier and the ski pole assembly of the present invention showing the skier in the standing position.
Figure 2:
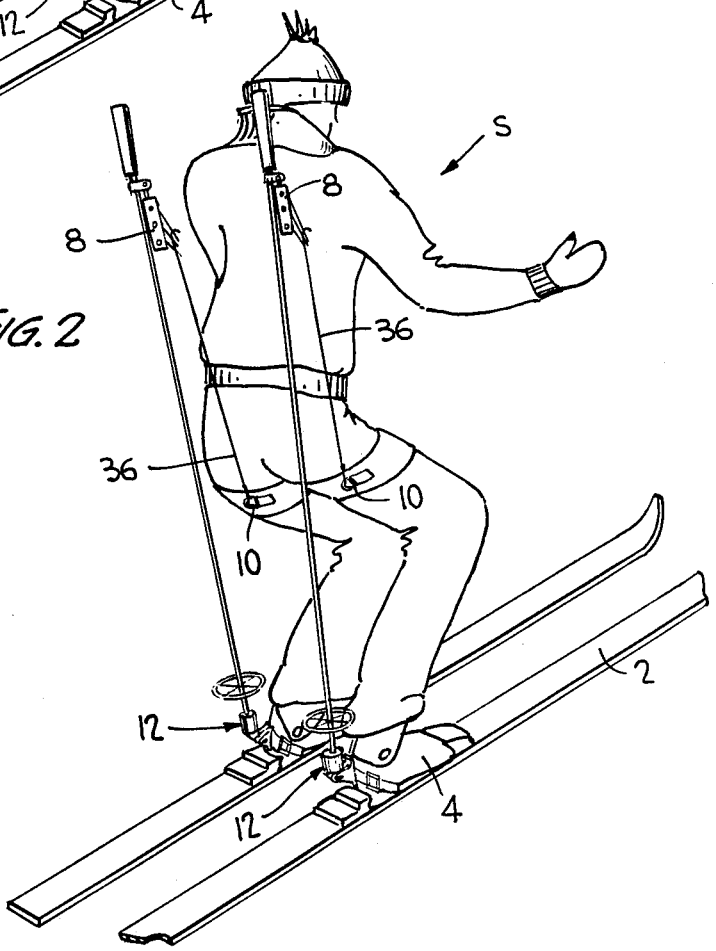
FIG. 2 is a perspective view of a skier and ski pole assembly of the present invention showing the skier in the skiing position.

Referring to FIGS. 1 and 2, a skier S is shown in the standing position and in the crouched skiing position, respectively, using the ski pole assembly of this invention. The ski pole assembly as illustrated is used with conventional skis 2, ski boots 4, and ski poles 6. The respective parts of the ski pole assembly can be used interchangeably on either of the ski poles, ski boots, and legs of the skier, i.e. there is no right or left leg design. Accordingly, for convenience, the description of the invention will refer to the parts of the invention in the singular.

Generally, the ski pole assembly of this invention comprises spring means 8 attached to ski pole 6, an attachment means 10 removably attached to the back of a leg of the skier, and a socket means 12 attached to the back of the ski boot. Prior to describing a preferred embodiment of the invention, it is pointed out that the parts of the ski pole assembly may be made of any conventional materials capable of withstanding the rigors of skiing. The preferred materials are generally metal and plastics. Additionally, the parts of the ski pole assembly are preferably color coordinated with the various ski equipment and clothing available to the skier.

Spring means 8 is attached to ski pole 6 by any conventional means such as clamp 20 and pin 22. An eyebolt 24 connects clamp 20 with bracket 26 which holds three, seven pound constant force springs 27, 28, and 29 by any conventional fastening means such as rivets 32, although a conventional bolt and nut construction may be used. The constant force springs are formed from coiled sheets of spring steel having first distal ends contiguous to plastic drums 30 and second distal ends selectively connectable to the skier. The use of six, seven pound constant force springs will provide about 42 pounds of tension and thereby shift from about 36 to 40 pounds of upper body weight to the skis and ski boots through the springs and ski poles, and has been found effective for a skier weighing from about 190 to 220 pounds. The upper body weight is shifted due to the stretching of the springs in response to the movements of the skier as best shown in FIG. 2.

The type of spring means used is not critical to the invention provided that it is capable of bearing upper body weight, and of transferring it to the ski or ski boot, bypassing the leg with the weight. For example, other type spring means may be used such as extension springs, compression springs, elastic straps, etc. Additionally, the number of springs and the pound tension is not critical and may be varied according to the needs of the skier. For example, a skier weighing from about 135 to 150 pounds may only require two five pound springs for each spring means 8.

An S hook 34 is attached to holes 35 in the springs 27 and 28 and a resilient cord 36, e.g. nylon, is attached to S screw 34 and extended through hole 35 in spring 29. A snap hook 38 is attached to the end of cord 36 for attachment to attachment means 10.

It should be understood that S hook 34 and cord 36 may be selectively attached to either all available springs or a lesser number. For example, if six springs are provided, S hook 34 and cord 36 would be attached to only two of the six springs for a lightweight skier; perhaps to three or four springs for a middleweight skier; and to all six springs for a heavyweight skier. The S hook 34 and cord 36 provide the flexibility of being able to select the number of springs to be connected to the skier according to the skier's body weight.

Attachment means 10, as above stated, can be any conventional attachment means such as a ring as shown in the preferred embodiment. The attachment means 10 is attached to the back of each of the skier's legs for connectedly receiving snap hook 38 of spring means 8. Attachment means 10 may be attached by means of a removable strap 39 having any conventional fastening means. Additionally, attachment means 10 may be sewn directly to the ski pants. When the attachment means 10 is sewn directly to the ski pants, sufficient reinforcement is required to avoid pulling the attachment means 10 from the ski pants.

Figure 4:
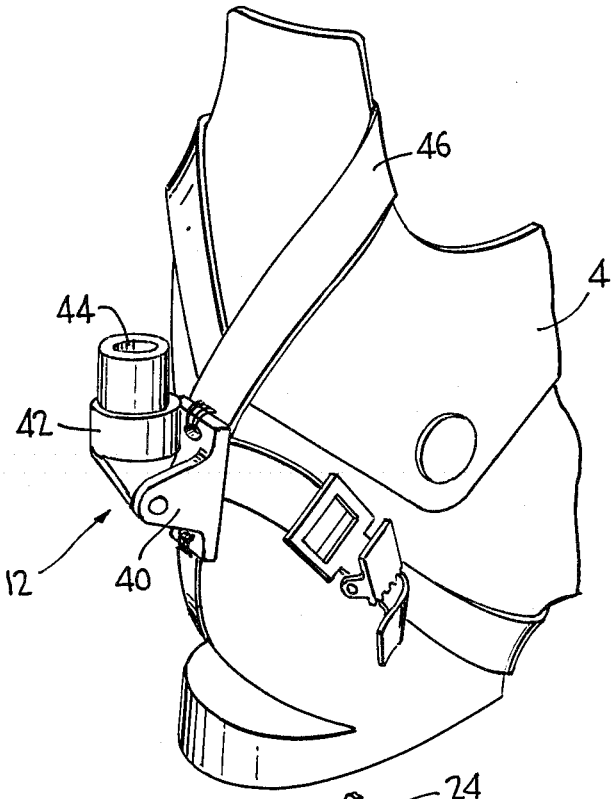
FIG. 4 is a perspective view of the hinge and socket means of the ski pole assembly attached to a ski boot.
Figure 5:
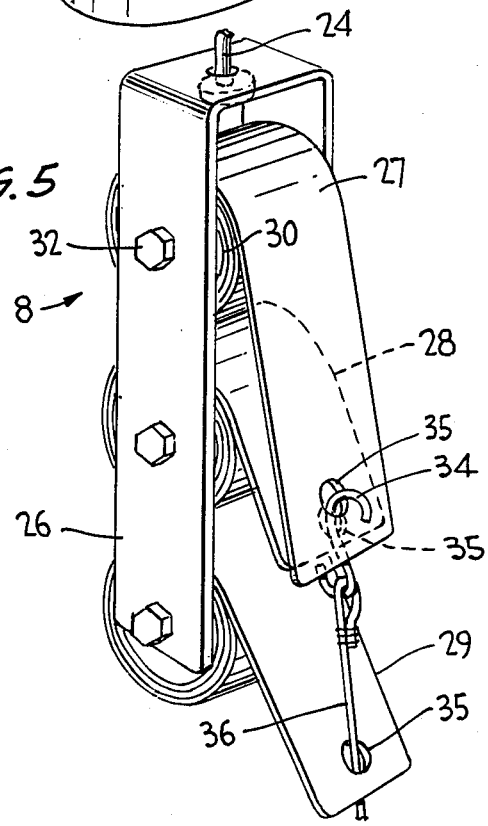
FIG. 5 is a perspective view of one embodiment of the spring means of the ski pole assembly of the present invention.

A socket means 12 is connected to the back of ski boot 4 for receiving and holding the tip of ski pole 6. The socket means 12 comprises a hinge 40 and a socket 42 having an opening 44 capable of receiving and holding the tip of ski pole 6 when the ski pole assembly is in use. The socket means 12 may be connected to the ski by any conventional means such as a strap 46. Strap 46 is fitted on the ski boot as best shown in FIG. 4. Additionally, hinge 40 may be connected directly to the ski boot by conventional means such as rivets.

Figure 3:
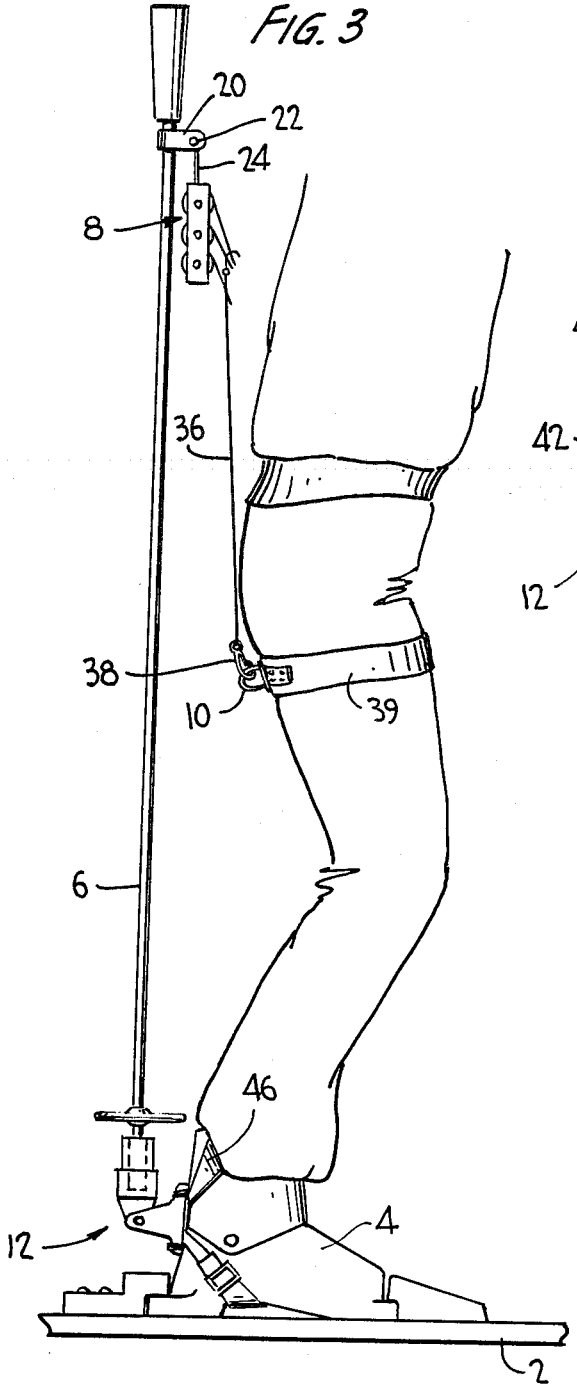
FIG. 3 is a partial side view of the skier and the ski pole assembly of the present invention.

Referring to FIGS. 1, 2, and 3, the method of using the ski pole assembly will now be described. At the beginning of the ski day, the skier will put on straps 39 with attachment means 10 on each of his legs, and straps 46 with socket means 12 on each of ski boots 4. Spring means 8 will have previously been attached to ski poles 6. Prior to skiing down the ski slope, the skier connects each of the spring means 8 by snap hook 38 to each of the attachment means 10 and ski poles 6 are inserted into openings 44 of sockets 42. When skiing down the slope, the springs 27, 28, and 29 will stretch in response to the crouching movements of the skier's legs generating forces in opposition to forces generated by the skier's body weight thereby shifting the upper body weight of the skier from the skier's legs through the spring means 8 and ski poles 6 to the skis and ski boots of the skier. The shifting of the upper body weight of the skier to the skis and ski boots will reduce the strain on the skier's legs and reduce fatigue to the skier caused by such strain.

While the ski assembly of the present invention has been described for use by a skier using a pair of skis, it could also be used by a skier using a single ski. For example, a handicapped skier skiing on one leg would find it very helpful to shift body weight from that single leg. Another example of use of a single ski is for "ski boarding". These ski boards resemble surfboards, and are attachable to both of the skier's feet.

The above-described invention provides a novel and simple ski pole assembly which is easy to use and inexpensive to manufacture. While the preferred embodiments of the invention have been described in detail above, various modifications and variations of the invention are possible in light of the above teachings. It is, therefore, to be understood that within the scope of the appended claims the invention may be practiced otherwise than as above-described.

It is claimed:

1. A ski pole assembly for shifting the upper body weight of a skier from the skier's legs to the skier's skis and ski boots through a first and second ski pole comprising:

(a) a first spring means attachable to said first ski pole and having means for connection to the back of a first leg of said skier and a second spring means attachable to said second ski pole and having means for connection to the back of a second leg of said skier;

(b) a first attachment means attachable to the back of said first leg of said skier for connectedly receiving said first spring means and a second attachment means attachable to the back of said second leg of said skier for connectedly receiving said second spring means; and (c) a first socket means attachable to a first ski boot of said first leg of said skier for receivably holding the tip of said first ski pole and a second socket means attachable to a second ski boot of said second leg of said skier for receivably holding the tip of said second ski pole;

said first spring means being attachable to said first attachment means, said second spring means being attachable to said second attachment means, said first ski pole being placable in said first socket means and said second ski pole being placable in said second socket means, whereby said spring means will stretch in response to the movements of said skier thereby shifting the skier's upper body weight from the legs of the skier to said skis and ski boots of the skier.

2. A ski pole assembly according to claim 1 wherein the first and second spring means are selected from the group consisting of constant force springs, extension springs, compression springs, and elastic straps.

3. A ski pole assembly according to claim 1 wherein said first and second spring means comprise a bracket means connected to said first and second ski poles and said bracket means having connected thereto three constant force springs with means for attachment to said attachment means.

4. A ski pole assembly according to claim 1 wherein the attachment means comprises a ring.

5. A ski pole assembly for shifting the upper body weight of a skier from the skier's legs to the skier's skis and ski boots by transferring the weight through the skier's ski poles comprising spring means attached to each of said ski poles and said spring means being connected to an attachment means on the back of the skier's legs, and the tips of said ski poles being insertable into socket means attached to said ski boots whereby said spring means stretch in response to the movements of said skier thereby shifting the skier's upper body weight from the legs of the skier to the skis and ski boots of the skier.

6. A method for shifting the upper body weight of a skier from the skier's legs to the skier's skis and ski boots by transferring the weight through the skier's ski poles comprising spring means attached to each of said ski poles and said spring means being connected to an attachment means on the back of the skier's legs, and the tips of said ski poles being inserted into socket means attached to said ski boots whereby said spring means stretch in response to the movements of said skier thereby shifting the skier's upper body weight from the legs of the skier to the skis and ski boots of the skier.

7. An apparatus for shifting the body weight of a skier from the skier's legs to a skier's ski or skis through the skier's boot or boots as the skier crouches over the ski or skis comprising:

spring means for generating forces in opposition to forces generated by the skier's body weight, the forces generated by said spring means being substantially constant for any position of crouching movement of the skier's between a standing position and a fully crouched position of the skier; and rigid support means for supporting said spring means in a raised position above said ski or skis; and means for detachably connecting said spring means and said rigid support means between said boot or boots and the skier;

whereby said spring means support a portion of the skier's body weight as the skier crouches during skiing, thereby shifting that portion of body weight from the skier's legs to the ski or skis through the skier's boot or boots.

8. The apparatus of claim 7 wherein said rigid support means includes rigid pole means extending upwardly from said ski or skis, and said means for detachably connecting includes first coupling means for attaching the bottom ends of said pole means to said boat or boats, second coupling means for attaching said pole means to said spring means, and third coupling means for attaching said spring means to said skier.

9. The apparatus of claim 8 wherein said first coupling means includes socket means associated with the boot or boots of the skier for detachably receiving the bottom end of said pole means.

10. The apparatus of claim 9 wherein said third coupling mean includes straps attachable to the thigh or thighs of the skier's legs.

11. The apparatus of claim 8 wherein said third coupling means includes straps attachable to the thigh or thighs of the skier's legs.

12. The apparatus of claim 7 wherein said spring means comprises a plurality of individual springs, each spring being capable of generating predetermined forces, whereby the number of springs provided and respective predetermined forces can be selected according to a range of possible body weights of skiers.

13. The apparatus of claim 12 wherein said springs are supported in a common bracket and said springs are selectively attachable to said skier by connecting means, the number of springs selected for attachment to the skier being related to the skier's body weight.

14. The apparatus of claim 13 wherein each spring comprises a coiled sheet of spring material, each coiled sheet having one distal end contiguous to a drum on which the sheet is coiled and a second distal end selectively attachable to said connecting means, said drums being spaced in said bracket.

15. The apparatus of claim 14 wherein said connecting means comprises apertures in the second distal end of each coiled sheet, a cord connectable between said coiled sheets and the skier, and an S hook on one end of said cord selectively connectable to one or more said apertures in one of said coiled sheets disposed at the furthest distances from said skier, said cord being selectively feedable through other one of said apertures in coiled sheets disposed closer to said skier.

16. A method for shifting the body weight of a skier from the skier's legs to the skier's ski or skis through the skier's boot or boots as the skier crouches over the ski or skis comprising the steps of:

providing spring means which generate forces in opposition to forces generated by the skier's body weight, the forces generated by said spring means being substantially constant for any position of crouching movement of the skier's legs; and connecting said spring means between the skier's boot or boots and the skier with a rigid support means which supports the spring means in a raised position above said ski or skis, whereby said spring means support a portion of the body weight of said skier during skiing, thereby shifting a portion of the skier's body weight from the skier's legs to the skier's ski or skis as the skier crouches during skiing.

17. An apparatus for shifting the body weight of a skier from the skier's legs to a skier's ski or skis through the skier's boot or boots as the skier crouches over the ski or skies comprising:

spring means for generating forces in opposition to forces generated by the skier's body weight; and means for detachably connecting said spring means between said boot or boots and the skier, said means for detachably connecting including rigid pole means extending upwardly from said ski or skis, first coupling means for attaching the bottom ends of said pole means to said boot or boots, said first coupling means including socket means associated with the boot or boots of the skier for detachably receiving the bottom end of said pole means, second coupling means for attaching said pole means to said spring means, and third coupling means for attaching said spring means to said skier;

whereby said spring means support a portion of the skier's body weight as the skier crouches during skiing, thereby shifting that portion of body weight from the skier's legs to the ski or skis through the skier's boot or boots.

18. An apparatus for shifting the body weight of a skier from the skier's legs to a skier's ski or skis through the skier's boot or boots as the skier crouches over the ski or skis comprising:

spring means for generating forces in opposition to forces generated by the skier's body weight, said spring means including a plurality of individual springs, each spring being capable of generating predetermined forces, the number of springs provided and respective predetermined forces being selectable according to a range of possible body weights of skiers, said springs being supported in a common bracket and being selectively attachable to said skier by connecting means, the number of springs selected for attachment to the skier being related to the skier's body weight;

rigid support means for supporting said spring means in a raised position above said ski or skis;

means for detachably connecting said spring means and said rigid support means between said boot or boots and the skier;

whereby said spring means support a portion of the skier's body weight as the skier crouches during skiing, thereby shifting that portion of body weight from the skier's legs to the ski or skis.

19. An apparatus for shifting the body weight of a skier from the skier's legs to a skier's ski or skis through the skier's boot or boots as the skier crouches over the ski or skies comprising:

spring means for generating forces in opposition to forces generated by the skier's body weight;

rigid support means for supporting said spring means in a raised position above said ski or skis;

means for detachably connecting said spring and said rigid support means between said boot or boots and the skier, said spring means including at least one coiled sheet of spring material, the coiled sheet being wound on a drum and having one distal end contiguous to a drum on which the sheet is coiled and a second distal end selectively attachable to the means for detachably connecting;

whereby said spring means support a portion of the skier's body weight as the skier crouches during skiing, thereby shifting that portion of body weight from the skier's legs to the ski or skis.

* * * * *